United States Patent [19]

Sherman

[11] 4,334,923

[45] Jun. 15, 1982

[54] OXIDATION RESISTANT STEEL ALLOY

[75] Inventor: Andrew M. Sherman, Southfield, Mich.

[73] Assignee: Ford Motor Company, Dearborn, Mich.

[21] Appl. No.: 122,915

[22] Filed: Feb. 20, 1980

[51] Int. Cl.[3] ..... C22C 38/02; C22C 38/06

[52] U.S. Cl. ..... 75/124; 148/31.5

[58] Field of Search ..... 75/123 E, 123 L, 124 R, 75/124 E, 124 F; 148/36, 37, 31.55, 31.5

[56] References Cited

U.S. PATENT DOCUMENTS

| | | | |
|---|---|---|---|
| 2,830,922 | 4/1958 | Ahles | 148/31.55 |
| 3,298,826 | 1/1967 | Wukusick | 75/124 E |
| 4,065,330 | 12/1977 | Masumoto et al. | 75/124 R |

FOREIGN PATENT DOCUMENTS

| | | | |
|---|---|---|---|
| 1262588 | 2/1972 | United Kingdom . | |
| 2019886 | 7/1979 | United Kingdom | 75/126 G |

OTHER PUBLICATIONS

GEMP 53-A; *High Temperature Materials Program Progress Report,* No. 53, Part A, USAEC, pp. 26–29, (1965).

*Reactor Materials,* Spring 1967, pp. 46–47.

Henderson, J. G. et al., *Metallurgical Dictionary,* Reinhold Pub. Corp., New York, N.Y., p. 184, (1953).

*Primary Examiner*—Michael L. Lewis

*Attorney, Agent, or Firm*—Joseph W. Malleck; Olin B. Johnson

[57] ABSTRACT

An oxidation resistant ferritic steel alloy composition is disclosed consisting essentially of up to 0.05 carbon, 0.1–2% silicon, 2–8% aluminum, 0.02–1.0% yttrium, the balance being substantially iron and normal impurities.

4 Claims, No Drawings

OXIDATION RESISTANT STEEL ALLOY

BACKGROUND OF THE INVENTION

This invention relates to metal alloys and particularly to Fe-Al alloys which can be used in high temperature oxidation environments, such as in a catalytic converter for controlling automotive emission gases. The development of high temperature metal alloys, resistant to oxidation at such temperatures, first used nickel or cobalt based super alloys as well as austenitic stainless steels. In an effort to lower cost and thereby increase applications of such metals, the prior art proceeded to use less rich iron based alloys containing either aluminum, chromium or silicon. These binary alloys were less costly and did provide some degree of oxidation resistance but failed to provide proper oxidation resistance at temperatures in the range of 500°-800° C. and under long time or cyclic high temperature excursions.

For example, the binary alloy of iron and aluminum offers protection which is due to the preferential oxidation of the aluminum to form an aluminum oxide film. This film tends to protect the alloy surface from further oxidation, but when there is a break in the film, such binary alloy is subject to failure because of the growth of iron oxide nodules in generally the 500°-800° C. range. It is generally believed that the growth of the aluminum oxide film depleted the subjacent iron alloy of aluminum so that when a break did occur in the protective oxide film, the iron rich substrate was directly exposed to the atmosphere and iron oxide nodules began to form. Above 800° C., failure occurs by a mechanism of pealing of the protective oxide. Increasing the aluminum concentration within a binary iron alloy tends to suppress the iron oxide nodule formation, but above eight percent, the alloy becomes disadvantageously unworkable in the cold mill.

Each of the above-mentioned binary alloys possess some disadvantage that prompts further development. As indicated, the iron/aluminum alloy produce catastrophic oxidation failure at temperatures above 500° C. The iron/chromium alloys with the high chromium content, such as are well known in stainless steels, are simply too expensive. The iron/silicon alloys suffer from processing problems associated with the formation of a low melting iron/silicon/oxygen phase (fayalite) when reheated for hot working. The fayalite drips off the ingots and slabs and fills up the furnace bottoms much faster than the solid scale that is formed thereon.

The prior art, in its search to provide a low cost, high temperature resistant metal, proceeded to use one or more additional active elements to back up aluminum in a binary alloy. The additional elements, such as chromium or silicon, act as a getter of oxygen, preventing diffusion of the oxygen into the alloy once a break occurred in the primary protective oxide film. This prevented growth of the iron oxide nodule, but even these ternary alloys proved to be disadvantageous because they had a limited suitability under sustained high temperature exposure and particularly under cyclic heating and cooling conditions wherein thermal shock resulted in flaking and spalling of the oxide coating. What is needed is an alloy composition which lends itself to low cost manufacture and at the same time offers high temperature resistance performance which is not affected by cyclic heating conditions which cycle from a temperature below 600° C. to above 900° C., and preferably 1000° C.

SUMMARY OF THE INVENTION

This invention is a ferritic Fe-Al alloy composition useful advantageously as a metal substrate in applications experiencing thermal excursions or cycling between temperatures below 600° C. and above 900° C. The composition employs additional active elements limited to a total of three percent or less and yet affords oxidation resistance under cyclic heating conditions or sustained high temperatures which is better than the best Fe-Al alloys known to date which must contain at least 10-25% additional elements. The composition consists essentially of up to 0.05% carbon, 0.1-2% silicon, 2-8% aluminum and 0.1-1% yttrium, the balance being substantially iron and normal impurities. In certain modifications, it is preferred to control the ingredients to narrower limits comprising 0.1-1% silicon, 5-7% aluminum, and 0.7-0.8% yttrium. The impurities should be preferably controlled to less than 0.009% phosphorus, less than 0.006% sulfur, less than 0.009% oxygen, and carbon should preferably be controlled to less than 0.03%.

The iron/aluminum/silicon alloy of this invention, upon being exposed to a heated environment above 600° C., will form a planar or smooth oxide layer consisting of aluminum oxide which has improved adherence to the substrate. When further heated to about 1000° C., the alloy will form a complex oxide of Al/Si-oxide/$AlYO_3$ which imparts increased resistance to catastrophic oxidation failure from thermal cycling. The latter oxide morphology prevents oxide spallation under cyclic heating at least for a minimum of ten cycles between 1000° C. and room temperature, with the total time at 1000° C. being 200 hours.

DETAILED DESCRIPTION

Most research work devoted to improving the oxidation resistance of iron based alloys has been aimed at continuous exposure to temperatures over 900° C. Very little effort has been directed to improving the oxidation resistance of such metals under cyclic temperature excursions between temperatures well below 900° C. (more particularly below 600° C. down to room temperature) and 1000° C.

Many engineering applications experience such excursions where the material is generally exposed at moderately high temperatures and occassionally is subjected to the much higher temperatures. It is important that a leaner iron based alloy, devoid of expensive ingredients, be developed that will perform under such conditions.

Pursuant to this, a series of six different sample alloys were prepared having compositions as set forth in Table 1. Impurities were preferably limited as follows: less than 0.009% phosphorus, 0.006% sulfur, 0.009% oxygen, and 0.03% carbon. Each of the samples were cleaned and exposed to the same high temperature oxidation environment. All samples, except 6, were prepared from vacuum melted ingots which were hot and then cold rolled to approximately 2.5 mm (0.01 inches) thick sheets; sample 6 was obtained from a commercial supplier. The samples were cut from the sheets in a size of approximately 31.75 mm (1.25 inches) square and were cleaned.

TABLE I

| Alloy | Al | Cr | Si | Y | C | P | S | O |
|---|---|---|---|---|---|---|---|---|
| | Compositions of Alloys (in wt. %) | | | | | | | |
| 1 | 5.8 | | | | 0.032 | 0.003 | 0.003 | 0.0032 |
| 2 | 9.8 | | | | 0.005 | 0.001 | 0.004 | 0.0026 |
| 3 | 5.0 | 27.7 | | | 0.029 | 0.007 | 0.006 | 0.004 |
| 4 | 6.1 | | 1.00 | | 0.005 | 0.001 | 0.004 | 0.0032 |
| 5 | 6.1 | | 1.01 | 1.02 | 0.006 | 0.001 | 0.001 | 0.0086 |
| 6 | 5.0 | 16.3 | | .38 | .022 | .099 | <.001 | .0044 |

Each of the samples was cleaned by degreasing in trichlorethylene and then dipped for ten minutes in a solution containing 40% hydrogen peroxide and 60% phosphoric acid. The samples were then rinsed in hot water and rinsed in methyl alcohol and dried. The cleaning procedure substantially removed the thin oxide layer residing on the samples and such procedure did not result in contamination of the surface by phosphorus or other impurities. This evaluation of the cleaning procedure was checked by examination using auger electron spectroscopy. Each of the samples was examined for any oxygen content to depths of up to 1900 angstroms from the surface.

The heating exposure was carried out by placing the samples in a box furnace with an air atmosphere. Temperatures within the furnace were controlled to plus or minus 5° C. Loading of the samples into the furnace was accomplished by means of fixtures on which the samples were suspended on thin oxidation resistant metal strips, the strips passing through a small hole in one corner of each sample.

Two basic types of experiments were performed, (1) exposure of the set of samples at elevated temperatures of 600°,800° and 1000° C. for fixed periods of time up to 500 hours, and (2) repeated cycles of exposure to high temperatures of 800° and 1000° C. for 20 hours, followed by cooling to room temperature.

Following such heating sequence, the samples were evaluated by measuring weight gain or loss and observation of the oxide layers on such samples by X-ray diffraction and by optical and scanning electron microscopy.

The weight gain data generated during the isothermal oxidation tests is set forth in Table 2. Weight gains, which are an indication of corrosion progress, are listed for each alloy after 500 hours of exposure, except in cases where catastrophic oxidation was experienced and in that case the weight gain at the time of the catastrophic oxidation is substituted. The results of the cyclic oxidation tests are shown in Table 3.

TABLE II

| Alloy | 600° C. | 800° C. | 1000° C. |
|---|---|---|---|
| | Weight Gains (mg/cm$^2$) After 500 Hour Exposures | | |
| 1 | (<1 hr.) | 0.040 (5 hrs.) | 0.120 (100 hrs.) |
| 2 | 0.012 (200 hrs.) | 0.056 (200 hrs.) | 0.145 (20 hrs.) |
| 3 | 0.011 | 0.160 | 0.230 |
| 4 | 0.010 | 0.200 | 0.760 (200 hrs.) |
| 5 | 0.012 | 0.100 | 0.380 |
| 6 | .016 | .360 | .440 |

TABLE III

| Alloy | 800° C. | 1000° C. |
|---|---|---|
| | Results of Cyclic Oxidation Tests | |
| | Cycles (time in hrs.) to Failure | |
| 1 | N.F.* | 3 (60) |
| 2 | N.F.* | 1 (20) |
| 3 | 20 (400) | 5 (100) |

TABLE III-continued

| Alloy | 800° C. | 1000° C. |
|---|---|---|
| | Results of Cyclic Oxidation Tests | |
| | Cycles (time in hrs.) to Failure | |
| 4 | 9 (180) | 2 (40) |
| 5 | N.F.* | N.F.* |
| 6 | N.F.* | N.F.* |

*N.F. - means no failure noted at termination of test (20 cycles - 400 hours at 800° C. or 10 cycles - 200 hours at 1000° C.).

Catastrophic oxidation takes two different forms, depending on the temperature. At between 600° C. and 800° C., catastrophic oxidation occurs by the formation of oxide nodules, which can be identified by X-ray diffraction as being $Fe_2O_3$. The second type of catastrophic oxidation occurs at higher temperatures (800°-1000° C.) where the protective oxide film buckles away from the metal substrate and cracks and flakes off causing erratic weight changes, since the oxidation of newly exposed underlying metal competes with the weight loss due to spallation.

From Tables 2 and 3, it is clear that the composition that best avoided catastrophic oxidation failure in all types of heating tested was that of a composition containing not only aluminum, but also the secondary elements of silicon and yttrium. It is true from Table 2 that increasing the amount of aluminum does delay catastrophic oxidation failure in isothermal heating. This is demonstrated by comparing alloy 2 with alloy 1; alloy 2 did fail by the growth of iron nodules, but the time to such failure was considerably in excess (200 hours) over alloy 1 which failed under less than one hour when heated to the low level temperature of 600° C. The same proportionate increase in life was experienced at the 800° C. heating level, but the trend was reversed when the specimens experienced the 1000° C. heating level.

It is also true from Table 2 that adding a second element such as chromium or silicon will impart oxidation resistance to the substrate and failure by nodule formation can be eliminated. This is demonstrated by samples 3, 4 and 5, each of which did not fail at 500 hours at each of the temperature levels of 600° C. and 800° C. But, it is significant that sample 4 (containing Si) showed poorer results when compared with sample 3 (containing Cr). This would suggest that development of the Fe-Al-Si system would not hold much promise. Sample 4 even failed at 1000° C., whereas sample 3 did not.

Although sample 6 (Fe-Al-Cr-Y) did not fail the cyclic testing of Table III, the same as sample 5 (Fe-Al-Si-Y), the rate of oxidation is greater and therefore the performance of sample 6 is poorer than sample 5 when the data of Table II is considered.

Nature of the Oxide Composition

Observations were made with respect to the nature of the oxide composition under isothermal heating conditions at various temperature levels. The observations were made by X-ray diffraction; diffraction scans on unoxidized samples of each alloy resulted in no detectable peaks other than those corresponding to alpha iron. Thus, the oxides detected in scans of the oxidized samples were formed during the exposure at elevated temperatures. These observations were of necessity made mostly on samples oxidized for the long times needed to grow oxide layers thick enough to generate enough diffraction lines of sufficient intensity to permit identification.

The oxide identification for all the alloys is shown in Table 4.

TABLE IV

| Oxides Formed on Samples After 200 Hour Exposures | | | |
|---|---|---|---|
| Alloy | 600° C. | 800° C. | 1000° C. |
| 1 | $Fe_2O_3$* | $Fe_2O_3$* | $Al_2O_3$* |
| 2 | NA* | $Al_2O_3$+* | $Al_2O_3$* |
| 3 | $Fe_2O_3$ | $Al_2O_3/Fe_2O_3/Cr_2O_3$ | $Al_2O_3/Fe_2O_3/Cr_2O_3$ |
| 4 | NA | NA | $Al_2O_3$* |
| 5 | $Fe_2O_3$ | $Al_2O_3$ | $Al_2O_3/AlYO_3$ |
| 6 | $Fe_2O_3$ | $Al_2O_3/Fe_2O_3$ | $Al_2O_3/Fe_2O_3$ |

*means identification was made, where possible, from areas of sample with little or no failure ($Fe_2O_3$ nodules or oxide flaking).
NA means no identification was possible due to thiness of oxide layer.
($Al_2O_3$ was found to be $\alpha Al_2O_3$ in all cases.)

On samples oxidized at 600° C., the only oxide identified was $Fe_2O_3$. In the case of alloys 1 and 2, which formed $Fe_2O_3$ nodules at 600° C., an effort was made to identify the composition of the oxide layer in an area with few or no nodules. The layer formed on alloy 2 proved to be too thin to provide adequate identification, while the profusion of nodules on the sample of alloy 1 made it impossible to obtain diffraction patterns free of $Fe_2O_3$ from the nodules. Consequently, no unambiguous determination of the oxide layer formed on alloy 1 could be made; it can only be said that no oxide other than $Fe_2O_3$ was detected.

That no aluminum oxide was detected on samples oxidized at 600° C. does not necessarily mean that none was formed. It is theorized that initially the supply of aluminum at the surface may not be sufficient to form an aluminum oxide layer. As exposure continues, such a layer does form in areas free of iron oxide nodules. However, at 600° C., the growth rate of aluminum oxide is so slow that not enough is present, even after long exposures to allow X-ray diffraction identification.

During exposures at 800° C. and 1000° C., aluminum oxide predominates in the oxide film, with the exception of alloy 1. That no aluminum oxide is detected on alloy 1 at 800° C., but is detected on other alloys containing six percent aluminum plus chromium or silicon, is consistent with other observations that additional alloying elements promote formation of aluminum oxide layers at lower exposure temperatures. It has been suggested that this effect may be due to an oxygen gettering effect of the chromium or silicon.

Some $Cr_2O_3$ was detected in the oxide layer formed on alloy 3, which contained a high amount of chromium. In alloy 3 and 6, $Fe_2O_3$ was also detected. Optical and scanning electron microscopy indicated that the $Fe_2O_3$ was located in small patches or nodules which formed in a short time, but which did not grow appreciably during long exposures. Nevertheless, the existence of these patches may be an indication of incipient failure. Alloy 5 did not exhibit this characteristic.

On alloy 5, oxidized 1000° C., $AlYO_3$ was detected. The diffraction results from the sample oxidized at 800° C. indicated that $AlYO_3$ might be present. Examination by scanning electron miscroscopy of samples exposed at both temperatures revealed a dispersion of dark, blocky particles found by energy dispersive analysis to contain aluminum and yttrium. It is therefore concluded that $AlYO_3$ is present as particles embedded in the oxide layer. It is theorized that the profusion of $AlYO_3$ particles during the oxidation of alloy 5 is an indication that one percent yttrium content is greater than necessary.

As little as 0.01% yttrium is useful in retarding catastrophic oxidation under cyclic high temperature conditions. The optimum yttrium content is preferred to be in the range of 0.7–0.8%. With respect to silicon, tests show that about 1% is preferable and that 5–7% aluminum is optimum.

I claim:

1. An oxidation resistant ferritic steel consisting of up to 0.05% carbon, 0.1–2% silicon, 2–8% aluminum, 0.01–1.0% yttrium, and the balance substantially iron and normal impurities, characterized by the balance of catastrophic oxidation failure when subjected to at least 10 cyclic temperature excursions maximized between about 800° C. and about 1000° C., each cycle comprising at least 200 hours at said temperatures.

2. The steel composition as in claim 1, which when exposed to a temperature of about 1000° C. forms a complex oxide scale consisting of $Al_2O_3/AlYO_3$.

3. A ferritic steel resistant to catastrophic oxidation at thermal cycling maximized between 600° C.–1000° C., said steel composition consisting essentially of less than 0.05% carbon, 0.1–1% silicon, 5–7% aluminum, 0.7–0.8% yttrium and the balance being substantially iron and normal impurities characterized by the ability to be cold rollable, and by the absence of catastrophic oxidation failure when subjected to temperatures of 600° C. or greater for periods of up to 500 hours.

4. The steel as in claim 3, in which the steel is characterized by an oxidation weight gain of no greater than 0.1 mg/cm$^2$ at 800° C. for 500 hours and by an oxidation weight gain of no greater than 0.38 mg/cm$^2$ at 1000° C. for 500 hours.

* * * * *